US006166448A

United States Patent [19]

Ando et al.

[11] Patent Number: 6,166,448

[45] Date of Patent: Dec. 26, 2000

[54] STARTER HAVING A VIBRATION RESISTING MAGNET SWITCH

[75] Inventors: Kazuhiro Ando, Okazaki; Tsutomu Shiga, Nukata-gun; Takeshi Araki, Nishikasugai-gun, all of Japan

[73] Assignee: Denso Corporation, Kariya, Japan

[21] Appl. No.: 09/417,299

[22] Filed: Oct. 13, 1999

Related U.S. Application Data

[62] Division of application No. 08/974,681, Nov. 19, 1997, Pat. No. 5,994,786.

[30] Foreign Application Priority Data

Nov. 20, 1996 [JP] Japan ..... 8-308908
Sep. 29, 1997 [JP] Japan ..... 9-263011

[51] Int. Cl.[7] ..... F02N 15/00

[52] U.S. Cl. ..... 290/38 R; 74/6

[58] Field of Search ..... 290/38 R, 38 A, 290/46, 48; 74/6; 335/126

[56] References Cited

U.S. PATENT DOCUMENTS 5,367,913 11/1994 Yumiyama et al. ..... 74/7 A
5,610,445 3/1997 Shiga et al. ..... 290/38 R
5,831,340 11/1998 Kobayashi et al. ..... 290/38 R
5,834,852 11/1998 Katoh et al. ..... 290/38 R
5,894,256 4/1999 Kobayashi et al. ..... 335/126
5,994,786 11/1999 Ando et al. ..... 290/38 R

FOREIGN PATENT DOCUMENTS 56-117062 2/1955 Japan .

OTHER PUBLICATIONS

Journal of Nippondenso Technical Disclosure, 1/1992, Serial No. 82–113.

*Primary Examiner*—Nicholas Ponomarenko
*Attorney, Agent, or Firm*—Pillsbury Madison & Sutro LLP

[57] ABSTRACT

In a starter for an engine, a magnet switch attracts a plunger by a magnetic force generated by a solenoid coil wound around a sleeve, so that a pinion fitted on an output shaft of a starter motor is driven by movement of the plunger to engage with an engine ring gear. The the plunger is pressed to contact tightly with the sleeve, whereby the relative movement between the plunger and the sleeve is restricted as long as the coil is held deenergized. The pressing may be attained by an inclined surface provided on the plunger or a flexture of a transmitting member which connects the plunger and a pinion.

7 Claims, 6 Drawing Sheets

STARTER HAVING A VIBRATION RESISTING MAGNET SWITCH

This is a division of application Ser. No. 08/974,681, filed Nov. 19, 1997, now U.S. Pat. No. 5,994,786.

BACKGROUND OF THE INVENTION

1. Field of the Invention

The present invention relates to a starter for starting an engine.

2. Related Art

For a starter having a magnet switch, one conventional magnet switch is disclosed in JOURNAL OF NIPPON-DENSO TECHNICAL DISCLOSURE, Serial No. 82-113, published on Jan. 15, 1992.

This magnet switch for a starter has, as shown in FIG. 11, a plunger 100, taper portions 101 and 111 provided respectively on the plunger 100, a sleeve 110 forming a sliding surface of the plunger 100, and an elastic or resilient member 130 interposed between a plunger engaging portion 102 and an end 121 of a lever 120. With this construction, when the magnetic switch stops its operation (i.e., a standstill state), the plunger 100, urged by a return spring 140, stops in the state where the taper portion 101 of the plunger 100 is in contact with the taper portion 111 of the sleeve 110, and is held in a stable manner by the bias force of the return spring 140. Therefore, even if a large vibration is received from the outside, the plunger 100 is not moved in an axial direction (a lateral direction in FIG. 11) within the sleeve 100. The plunger 100 and the sleeve 110 become integral in effect, such that abrasions of the sleeve surface caused by relative movement of the plunger 100 and the sleeve 110 can be prevented.

However, this magnet switch has the following problems:

(1) an increase in the number of parts due to the provision of the elastic member 130, (2) an increase in manufacturing steps caused by the provision of the taper portions 101 and 111 on the plunger 100 and the sleeve 110, (3) a change in magnetic characteristic caused by the provision of the taper portion 101 in the plunger 100, (4) in the standstill state, since the lever 120 is pressed by the elastic force of the elastic member 130. (i.e, the lever 120 is not directly pressed by the return spring 140), the force for pressing and holding one-way clutch toward the axial rear end through the lever 120 lowers, and (5) since the intervention of the elastic member 130 between the plunger engaging portion 102 and the lever end 121 eliminates an engaging clearance therebetween, even if energization of the magnet switch is cut off after the start of an engine, there reduces a contact cut-off play set to cut off a motor contact when a pinion cannot be disengaged from a ring gear due to the inferior sliding or the like.

SUMMARY OF THE INVENTION

The present invention has been achieved in view of the above drawbacks and has an object to provide a starter in which at least in a standstill state of a starter, a plunger of a magnet switch is pressed and held at a fixed part of the starter to thereby provide a vibration resistance.

According to the present invention, at least when a starter is not in operation, a plunger of a magnet switch is moved in a diametrical direction of the plunger to be pressed against a fixed part, such as a sleeve for slidably holding the plunger in the magnet switch. As such when in a standstill state (i.e., the state where the starter stops its operation), the plunger is pressed against the fixed part. Therefore, even if a large vibration is received from the outside, the plunger and the fixed part are integrally maintained. As a result, it is possible to prevent abrasions on the inner peripheral surface of the sleeve caused by the axial sliding movement of the plunger within the sleeve upon receipt of external vibrations.

Preferably, the plunger is pressed against the fixed part of the starter by an inclined surface provided on a part of the plunger. Alternatively, the plunger may be pressed against the fixed part of the starter by an elastic member which connects the plunger and a pinion.

DETAILED DESCRIPTION OF THE PREFERRED EMBODIMENTS

A starter according to the present invention will be described in detail with reference to various embodiments shown in the accompanying drawings.

(First Embodiment)

Figure 1:
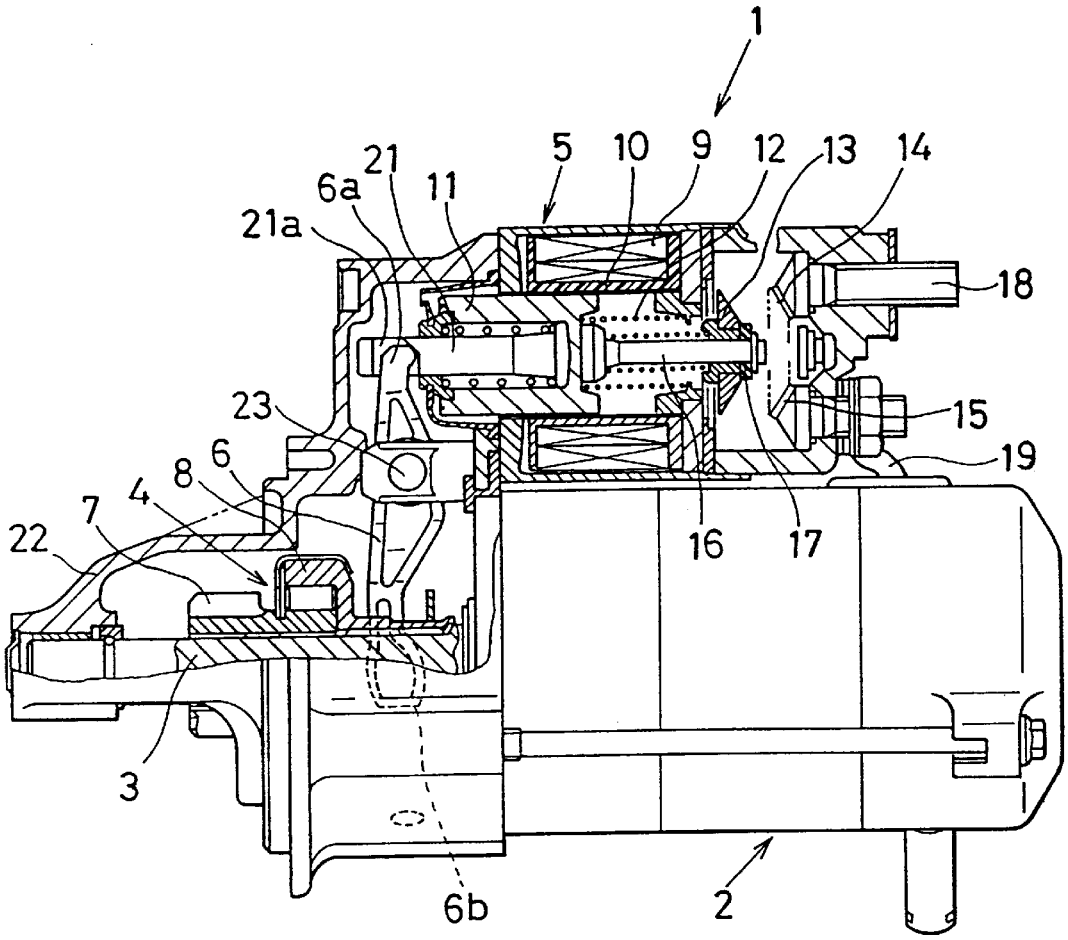
FIG. 1 is a sectional view of a starter according to a first embodiment of the present invention.

A starter 1 comprises, as shown in FIG. 1, a starter motor 2 for generating a turning force, an output shaft 3 rotated and driven by the starter motor 2, a pinion moving member 4 (provided so as to be axially movable on the output shaft 3, a magnet switch 5 for controlling the energization to the starter motor 2, a lever 6 for moving the pinion moving member 4 in an axial direction upon receipt of the operating force of the magnet switch 5, and the like.

The starter motor 2 has, as known in the art, an armature (not shown) rotatable by energization when a motor contact (described below) is closed by the magnet switch 5. The output shaft 3 is disposed coaxially with a rotational shaft (armature shaft) of the starter motor 2, and the rotation of the starter motor 2 is reduced by a reduction unit (not shown) and transmitted to the output shaft 3.

The pinion moving member 4 comprises, a pinion gear 7 engageable with a ring gear (not shown) of an engine, to transmit rotation of the output shaft 3 to the ring gear, a one-way clutch 8, for transmitting rotation of the output shaft 3 to the pinion gear 7, and a helical spline provided in the inner peripheral surface of the pinion moving member 4, which is fitted in a helical spline provided in the outer peripheral surface of the output shaft 3.

The magnet switch 5 comprises, a solenoid coil 9 for generating a magnetic force upon receipt of electric power, a cylindrical sleeve 10 disposed in the inner periphery of the coil 9, a plunger 11 disposed in an axially slidable manner within the inner periphery of the sleeve 10, and a return spring 12 for biasing the plunger 11 which opens and closes a motor contact as the plunger 11 moves. The motor contact comprises a movable contact 13, a fixed contact 14 on the battery side, and a fixed contact 15 on the motor side. The movable contact 13 is mounted on the axial end of a rod 16 connected to the plunger 11 through an insulating member 17, and is movably integral with the plunger 11. The fixed contact 14 on the battery side is provided integral with a battery terminal 18 connected to a battery (not shown) through a battery cable. The fixed contact 15 on the motor side is electrically connected to a positive pole brush (not shown) of the starter motor 2 through a lead wire 19.

When the coil 9 is energized, the plunger 11 receives the magnetic force generated by the coil 9, moves through the inner periphery of the sleeve 10 rightward in FIG. 1 against the bias force of the return spring 12. When the energization to the coil 9 is cut off and the magnetic force is extinguished, the plunger 11 is pushed back to the standstill position (position shown in FIG. 1) by the bias force of the return spring 12.

Figure 2:
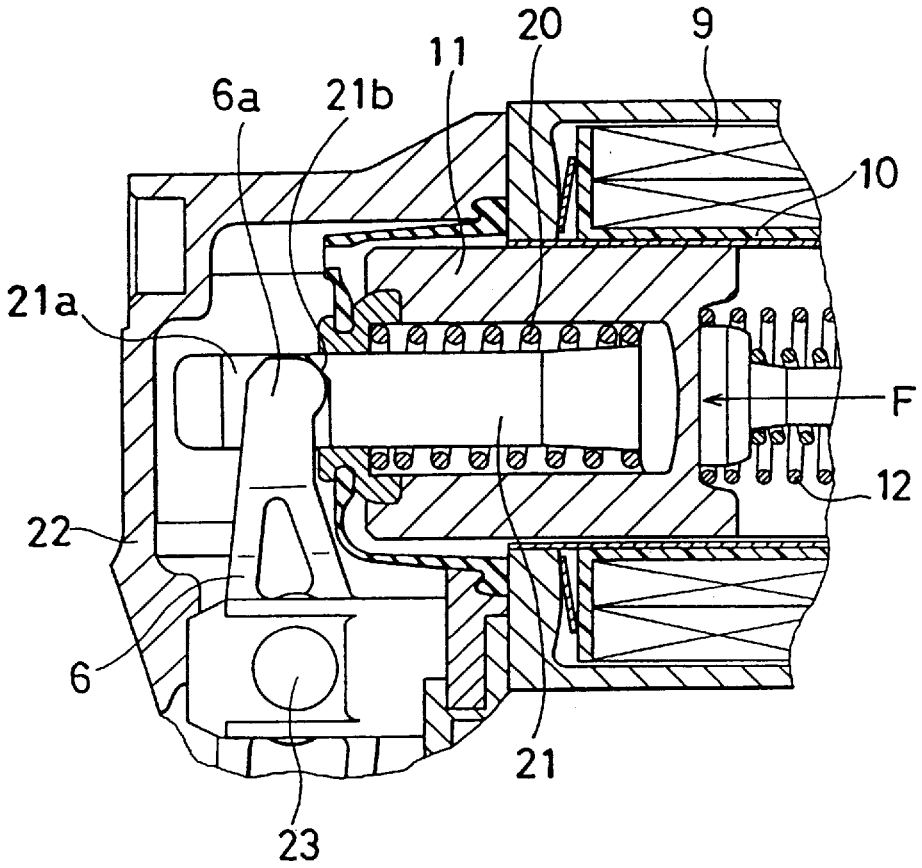
FIG. 2 is a sectional view of main part of a magnet switch used in the starter according to the first embodiment.
Figure 3:
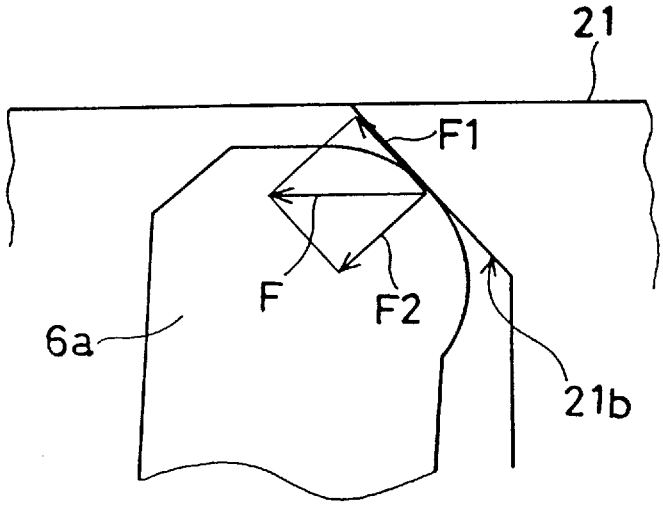
FIG. 3 is an enlarged view showing the bias force of a return spring applied to a lever from an inclined surface in the the first embodiment.

As shown in FIG. 2, this plunger 11 comprises a joint portion 21 connected through a spring 20, and an engaging recess 21*a* with which an upper end 6*a* of the lever 6 engages is formed in the end of the joint portion 21. The engaging recess 21*a* is provided with an inclined surface 21*b* in an abut surface with which one-side surface (a right side surface in FIG. 2) of the upper end 6*a* of the lever 6 when in the standstill state. This inclined surface 21*b* is constructed so that, as shown in FIG. 3, a component force F1, parallel with the inclined surface 21*b* out of the bias force F of the return spring 12, acts as the force for pressing the plunger 11 toward the inner peripheral surface of the sleeve 10.

The lever 6 has the upper end 6*a* provided in a generally round shape and engaged with the engaging recess 21*a* of the joint portion 21. The lever has the lower end 6*b* provided in a fork shape and engaged with the outer peripheral surface of the 10 cylindrical portion of the pinion moving member 4, which is rotatable around a support point 23, supported on a housing 22.

The starter according to this embodiment operates as described below.

When the coil 9 of the magnet switch 5 is energized to attract the plunger 11, the lever 6 turns or rotates around the support point 23. Therefore, the pinion moving member 4 connected to the lower end 6*b* of the lever 6 is forced out forward (left side in FIG. 1) along the helical spline on the output shaft 3, and the pinion moving member 4 stops in the state where the end of the pinion gear 7 abuts with the side end of the ring gear.

On the other hand, when the motor contact is closed by the further attraction of the plunger 11, that is, when the movable contact 13 abuts with both fixed contacts 14 and 15, the electric current flows from the battery to the armature so that the armature rotates, and the rotation of the armature is reduced by the reduction unit and transmitted to the output shaft 3. Thereby, the rotation of the output shaft 3 is transmitted to the pinion gear 7 through the one-way clutch 8. The pinion gear 7 rotates to the position capable of being meshed with the ring gear whereby the pinion gear 7 meshes with the ring gear so that the turning force is transmitted from the pinion gear 7 to the ring gear to start the engine.

After the start of the engine, the energization to the coil 9 of the magnet switch 5 is cut off to extinguish the magnetic force and the plunger 11, having been attracted so far, is pushed back to the standstill position by the bias force of the return spring 12. When the motor contact is thus opened, that is, when the movable contact 13 is moved away from both the fixed contacts 14 and 15 by the movement of the plunger 11 and the electric current to the armature is cut off, the rotation of the armature stops, and the pinion moving member 4 is pressed toward the axial rear end through the lever 6 and returned to the standstill position (the state shown in FIG. 1). At that time, the component force F1, parallel with the inclined surface 21*b* out of the bias force F of the return spring 12, acts on the plunger 11. Thereby, the plunger 11 is pressed obliquely left upward and pressed against the inner peripheral surface of the sleeve 10.

According to the present embodiment, when the starter 1 is not in operation, that is, when the operation of the magnet switch 5 stops, the plunger 11 is pressed against the inner peripheral surface of the sleeve 10 by the component force F1, parallel with the inclined surface 21*b* out of the bias force F of the return spring 12. Thereby, even if a large vibration is received from the outside, the plunger 11 is not slidably moved through the sleeve 10, and the plunger 11 and the sleeve 10 becomes integral in effect. Thus, the abrasion of the inner peripheral surface of the sleeve 10 can be prevented.

Further, when the magnet switch 5 is in operation, the inclined surface 21*b* is moved away from the one side surface of the upper end 6*a* of the lever when the plunger 11 begins to be attracted by the magnetic force of the coil 9. As such the force for pressing the plunger 11 against the inner diameter side of the sleeve 10 is extinguished to have no sliding resistance of the plunger 11.

Moreover, in the present embodiment, the component force F2, orthogonal to the inclined surface 21*b* out of the bias force F of the return spring 12, acts on the support point 23 of the lever 6 to apply the load to the support point 23. Therefore, even if the large vibration is received from the outside, the vibration of the lever 6 itself can be suppressed, resulting in suppressing the abrasion of the support point 23.

(Second Embodiment)

A starter 201 according to this embodiment comprises a starter motor 202 for generating a turning force, an output shaft 203 rotated and driven by the starter motor 202, a pinion moving member 204 helical spline-fitted on the output shaft 203, a magnet switch 205 for controlling the energization to the starter motor 202, a rotation control member 206 for controlling rotation of the pinion moving member 204 before the starter motor 202 starts, a transmission member 207 for transmitting an operating force of the magnet switch 205 to the rotation control member 206, and the like.

The starter motor 202 comprises a cylindrical-shaped yoke 208 forming a magnetic frame, an armature 212 in which both ends of an armature rotational shaft 209 are rotatably supported through bearings 210 and 211, a fixed magnetic pole 213 (for example, and a plurality of permanent magnets) secured to the inner periphery of the yoke 208 having a predetermined gap around the outer periphery of the armature 212, and the like. A motor contact (described below) is closed by the magnet switch 205 arranged substantially orthogonal to the motor shaft 209 for energization whereby the armature 212 rotates.

The output shaft 203 is disposed coaxially with the rotational shaft 209 of the armature 212, and the rotation of the armature 212 is reduced by a reduction unit and, subsequently, transmitted through the one-way clutch 214. A helical spline partially is formed in an axial direction of the output shaft 203.

The reduction unit constitutes a planet gear reduction mechanism by a sun gear 215 formed on the outer periphery on the extreme end side of the rotational shaft 209, an internal gear 216 disposed in the outer periphery in a diametrical direction of the sun gear 215, and a plurality of planet gears 217 interposed between the sun gear 215 and the internal gear 216 to mesh with both the gears 215 and 216.

The one-way clutch 214 receives a rotational output of the reduction unit through pins 218 journalling the planet gear 217 to transmit it to the output shaft 203.

The pinion moving member 204 is provided so as to be axially movable on the output shaft 203 with the helical spline provided in the inner periphery thereof, and fitted in the helical spline of the output shaft 203. The pinion moving member 204 is always biased rearward (rightward in FIG. 4) of the starter 201 by a spring 219 disposed frontwardly of the pinion moving member 204. The pinion moving member 204 is integrally formed with a pinion gear 220 meshed with a ring gear (not shown) provided on the drive shaft of an engine, and. a collar 221 having a larger outside diameter than that of the pinion gear 220 and having a number of teeth 221*a* on the outer periphery thereof is formed at the rear end of the pinion gear 220. A washer 223, rotatably supported through a roller 222, is disposed at the rear end of the pinion moving member 204.

The magnet switch 205 is encased in a rear case 224 disposed at the rear of the starter motor 202 and molded into a bowl-like configuration. The magnet switch 205 comprises a solenoid coil 225 for generating a magnetic force upon receipt of energization, a cylindrical sleeve 226 disposed in the inner periphery of the coil 225, a plunger 227 slidably disposed in the inner periphery of the sleeve 226, and a return spring 228 for biasing the plunger 227, and the like. The magnet switch 205 and opens and closes the motor contact as the plunger 227 moves.

Figure 4:
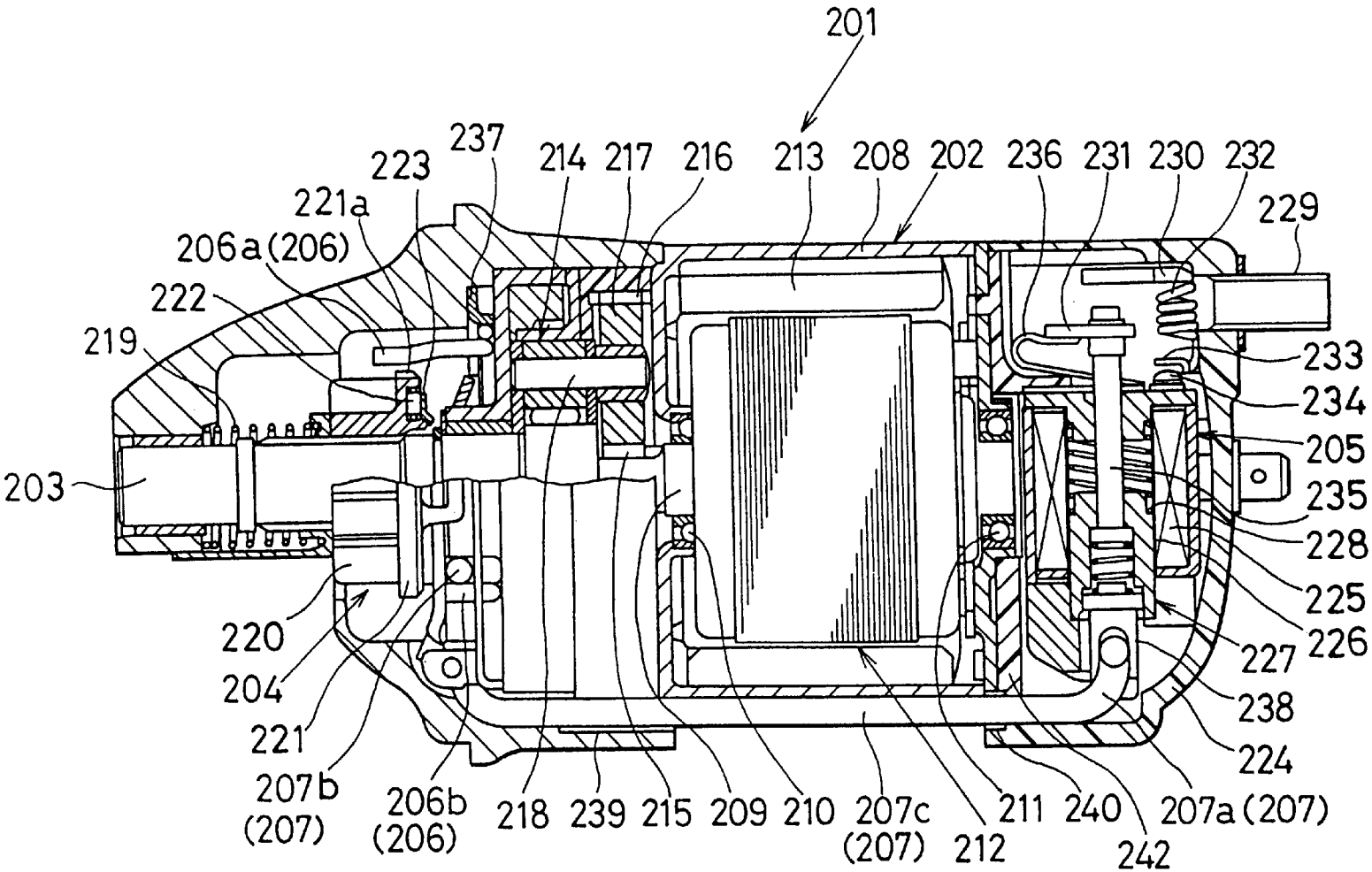
FIG. 4 is a sectional view of a starter according to a second embodiment of the present invention.

When the coil 225 is energized, the plunger 227 receives the magnetic force generated by the coil 225 and moves upward in FIG. 4 along the inner periphery of the sleeve 226, and when the coil 225 is deenergized so that the magnetic force is extinguished, the plunger 227 is returned to a standstill position (position shown in FIG. 4) by the bias force of the return spring 28.

The motor contact comprises a main fixed contact 230 provided integrally with a battery terminal 229, a main movable contact 231 which is movable corresponding to the main fixed contact 230, a resistor 232 that is electrically connected to the battery terminal 229, a sub-fixed contact 233 in conduction with the battery terminal 229 through the resistor 232, and a sub-movable contact 234 which is movable corresponding to the sub-fixed contact 233. Here, a spacing between the sub-fixed contact 233 and the sub-movable contact 234 is set to be smaller than that between the main fixed contact 230 and the main movable contact 231.

The main movable contact 231 is mounted on the upper end of a plunger rod 235 connected to the plunger 227, and is integrally movable with the plunger 227. The sub-movable contact 234 is connected to the main movable contact 231 through a copper plate 236 that is elastic.

The rotation control member 206 is held movably in a 20 vertical direction in FIG. 4 in the state where its axial movement is controlled by a plate 237, and is always biased upward by a return spring not shown. The rotation control member 206 is formed by winding a rod-like metal material in a loop-like manner and bending both ends 206*a* and 206*b* in the same direction 25 at substantially right angles. Both ends 206*a* and 206*b* are bended at right angles and are respectively taken out frontwardly of the plate 237. One end 206*a* is positioned in the outer periphery from the collar 221 of the pinion moving member 204 on the upper side in the diametrical direction of the output shaft 203, and the entire rotation control member 206 is moved downward, the end 206*a* can be engaged with the teeth 221*a* provided on the collar 221. The other end 206*b* is positioned on the lower side in the diametrical direction of the output shaft 203, and receives the operating force (for attracting the plunger 227) of the magnet switch 205 through the transmission member 207.

The transmission member 207 comprises a moving portion 207*a* formed of a material having adequate elasticity or resiliency (for example, iron) and engaged with a joint portion 238 of the plunger 227, an operating portion 207*b* which abuts with the other end 206*b* of the rotation control member 206, and a rod-like portion 207*c* which is linear rod-like and for connecting the moving portion 207*a* and the operating portion 207*b*.

The rod-like portion 207*c* is rotatably supported by two bearings 239 and 240 with the diametrical outside of the armature 212 disposed substantially parallel with the rotational shaft 209. The moving portion 207*a* and the operating portion 207*b* extend while being bent at substantially right angles to the rod-like portion 207*c* from both ends of the rod-like portion 207*c*.

In the transmission member 207, when the plunger 227 is attracted (moved upward in FIG. 4), upon receipt of the magnetic force of the coil 225, the moving portion 207*a* in engagement with the joint portion 238 follows the movement of the plunger 227. The rod-like portion 207*c* rotates according to the amount of movement of the moving portion 207*a* and the operating portion 207*b* turns or rotates around the rod-like portion 207*c* to thereby transmit the operating force of the magnet switch 205 to the other end 206*b*, which abuts with the operating portion 207*b*.

Figure 5:
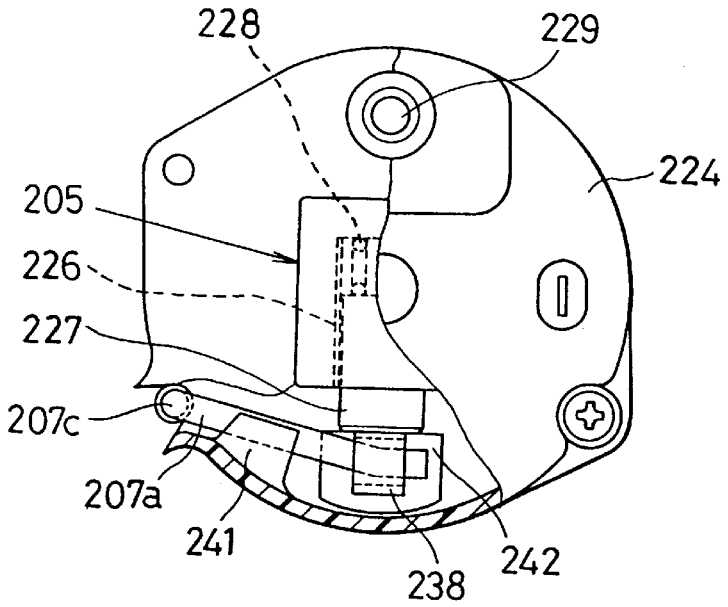
FIG. 5 is a view showing the relationship between a projecting wall and a moving part in a standstill state in the the second embodiment.
Figure 6:
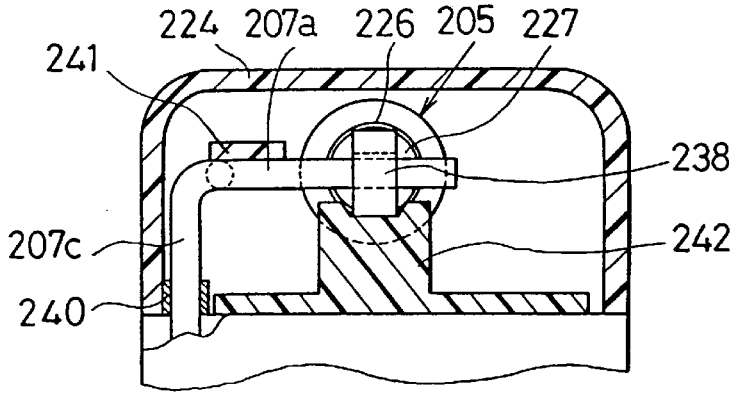
FIG. 6 is a sectional view showing the relationship between a projecting wall and a transmission member in the second embodiment.

Further, as shown in FIGS. 5 and 6, in the transmission member 207 the elastic force is applied to the moving portion 207*a* by a projecting wall 241, provided integrally with the inside of the rear case 224. More specifically, as shown in FIG. 6, the flexure is generated downward as shown in the moving portion 207*a* by the projecting wall 241 so that the joint portion 238 in engagement with the moving portion 207*a* is pressed against a holder wall 242.

The holder wall 242 is formed integrally with a brush holder for holding a brush (not shown), for example, to control an axial position of the plunger 227 which is biased by the return spring 228 (i.e., biased downward in FIG. 5) when the magnet switch 205 is in a standstill state, as shown in FIG. 5. In addition, the holder wall 242 supports the joint portion 238, biased in the axial direction of the plunger 227 and substantially vertically (downward in FIG. 6) by the flexure force of the moving portion 207*a*. That is, when the starter 201 is not in operation, the joint portion 238 is biased substantially orthogonal to the axial direction of the plunger 227 by the elasticity applied to the moving portion 207*a* from the projecting wall 241 and pressed against the holder wall 242. As a result, the plunger 227 is pressed to tightly contact the sleeve 226 so that the relative movement of the plunger 227 and the sleeve 226 may be restricted.

When the plunger 227 is attracted upon receipt of the magnetic force of the coil 225, the moving portion 207*a* follows the plunger 227 and rotates around the rod-like portion 207*c* (upward in FIG. 5), whereby it is disengaged from the projecting wall 241. A plurality of the projecting walls 241 may be provided.

Figure 7:
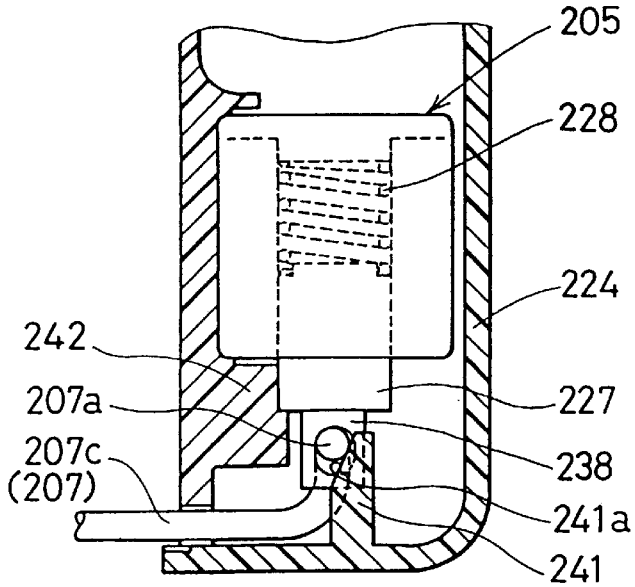
FIG. 7 is a sectional view showing the relationship between a projecting wall and a transmission member in a modification of the second embodiment.

Further, the projecting wall 241 may be modified to have its wall surface with which the moving portion 207*a* abuts, formed into an inclined surface 241*a* as shown in FIG. 7. In this case, when the starter 201 is not in operation, the moving portion 207*a* of the transmission member 207 is pushed against the inclined surface 241*a* of the projecting wall 241, whereby the elastic force can be applied to the moving portion 207*a* by reaction thereof.

The starter according to this embodiment operates as follows.

When the coil 225 of the magnet switch 205 is energized so that the plunger 227 is attracted, the moving portion 207*a* of the transmission member 207 rotates around the rod-like portion 207*c*. Therefore, the rod-like portion 207*c* and the operating portion 207*b* rotate integrally with the moving portion 207*a*. Thereby, the other end 206*b* of the rotation control member 206, which abuts with the operating portion 207*b*, is pressed downward in FIG. 4 so that the entire rotation control member 206 moves downward. As such, one end 206*a* comes into engagement with the teeth 221*a* of the collar 221 to control the rotation of the pinion moving member 204.

On the other hand, when the sub-movable contact 234 abuts with the sub-fixed contact 233 as the plunger 227 moves, an electric current flows into the armature 212 through the resistor 232 so that the armature 212 rotates at a low speed. The rotation of the armature 212 is reduced by the reduction unit, and then, transmitted to the output shaft 203 through the one-way clutch 214 to rotate the output shaft 203. The pinion moving member 204 also rotates with the rotation of the output shaft 203, but since the rotation of the pinion moving member 204 is restricted as described above, the rotation of the output shaft 203 acts as the force for pushing out the pinion moving member 204 in the axial direction through the helical spline. As a result, the pinion moving member 204 advances on the output shaft 203, and the pinion gear 220 can mesh with the ring gear.

Thereafter, when the pinion gear 220 advances to the ring gear so as to completely mesh with each other, and one end 206*a* of the rotation control member 206 is disengaged from the teeth 221*a* of the collar 221 and falls into the rear side of a washer 223 disposed at the rear end of the pinion moving member 204 whereby the rotation control of the pinion moving member 204 is released. Thereby, when the plunger 227 is further attracted so that the main movable contact 231 comes in contact with the main fixed contact 230, the resistor 232 is short-circuited so that a larger electric current flows into the armature 212, and the armature 212 rotates at a high speed. As a result, the turning force is transmitted from the pinion gear 220 to the ring gear, and the engine starts.

After the start of the engine, the coil 225 of the magnet switch 205 is deenergized to extinguish the magnetic force, the plunger 227, having been attracted so far, is pushed back to the standstill position by the bias force of the return spring 228. When the motor contact is opened by the movement of the plunger 227 to cut off the electric current to the armature 212, the rotation of the armature 212 stops. Further, when the plunger 227 returns to the standstill position, the transmission member 207 rotates around the rod-like portion 207*c* in the direction opposite to the direction when the plunger 227 is attracted. Therefore, the force for pressing downward the other end 206*b* of the rotation control member 206 through the operating portion 207*b* is extinguished. As a result, the rotation control member 206 is biased upward in FIG. 4 upon receipt of reaction of the return spring, and returns to the standstill position (position shown in FIG. 4).

The plunger 227 pushed back to the standstill position is biased downward in FIG. 6 through the joint portion 238 since the moving portion 207*a* of the transmission member 207 in engagement with the joint portion 238 is again engaged with the projecting wall 241 to generate the flexure force.

In the present embodiment, when the magnet switch 205 is in the standstill state, that is, when the starter 201 is not in operation, the joint portion 238, in engagement with the moving portion 207*a* of the transmission member 207, is biased substantially orthogonally to the axial direction of the plunger 227 upon receipt of the flexure force (elastic force) generated in the moving portion 207*a*, and pressed against the holder wall 242 (FIG. 6). Thereby, even if a large vibration is received from the outside, the plunger 227 is not slidably moved within the sleeve 226, and the abrasion of the inner peripheral surface of the sleeve 226 can be prevented.

When the magnet switch 205 is operated, the moving portion 207*a* is disengaged from the projecting wall 241 when the plunger 227 begins to be attracted by the magnetic force of the coil 225. Therefore, the force for pressing the joint portion 238 against the holder wall 242 is extinguished, thus causing no sliding resistance of the plunger 227.

(Third Embodiment)

Figure 8:
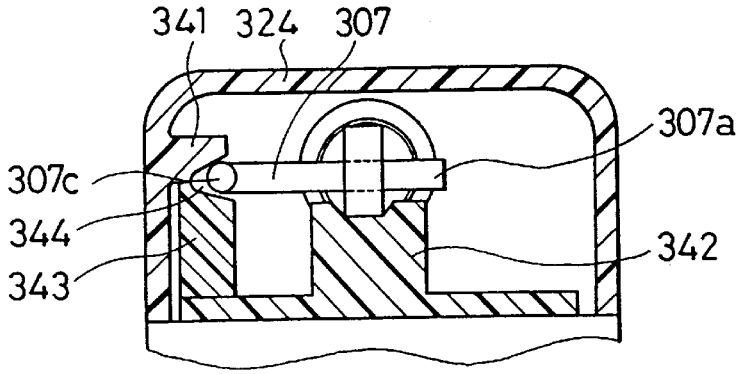
FIG. 8 os a sectional view showing the holding construction of the moving part of the transmission member in a third embodiment of the present invention.

In the present embodiment which is a variation of the second embodiment, as shown in FIG. 8, a projecting wall 341 provided internally of a rear case 324 and a wall portion 343 provided integrally with a holder wall 342 constitute a U-shaped groove 344 for holding the transmission member 307 (307*a*, 307*c*), and when the rear case 324 is assembled, the transmission member 307 is held in the U-shaped groove 344 while being flexed. Thereby, the transmission member 307 is enabled to be held in a further stable vibration resistant manner.

(Fourth Embodiment)

Figure 9:
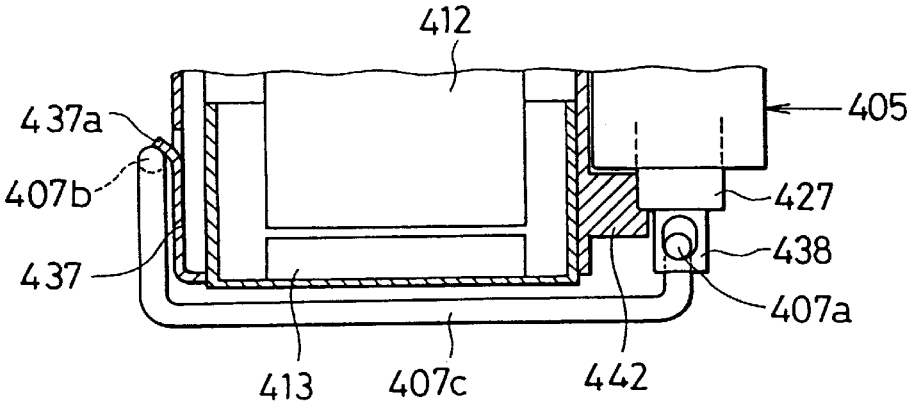
FIG. 9 is a sectional view showing the relationship between the transmission member and the plunger in the standstill state in a fourth embodiment of the present invention.

In the present embodiment which is also a variation of the second embodiment, as shown in FIG. 9, a plate 437 is partly cut up to form an inclined wall 437*a*, and only when the magnet switch 405 is in a standstill state, an end of an operating portion 407*b* is standstill in the state where it is stranded. Thereby, the entire transmission member (407*a* through 407*c*) moves forward (leftward in FIG. 9) of the starter having an armature 412 and a fixed magnetic pole 413, and the moving portion 407*a* of the transmission member pulls the joint portion 438 of the plunger 427 forwardly of the starter, and therefore, the plunger 427 is biased toward a holder wall 442 (leftward in FIG. 9) and is held in the state where the side of the plunger 427 is pressed against the holder wall 442 as shown in FIG. 9.

Figure 10:
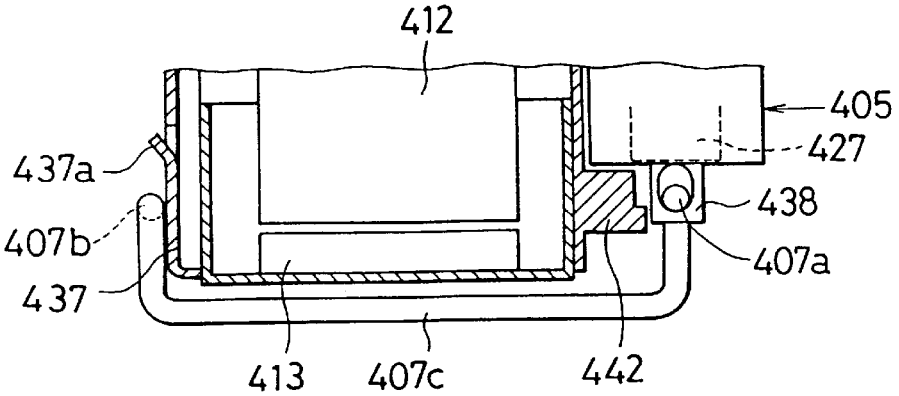
FIG. 10 is a sectional view showing the relationship between the transmission member and the plunger in the operating state in the fourth embodiment.
Figure 11:
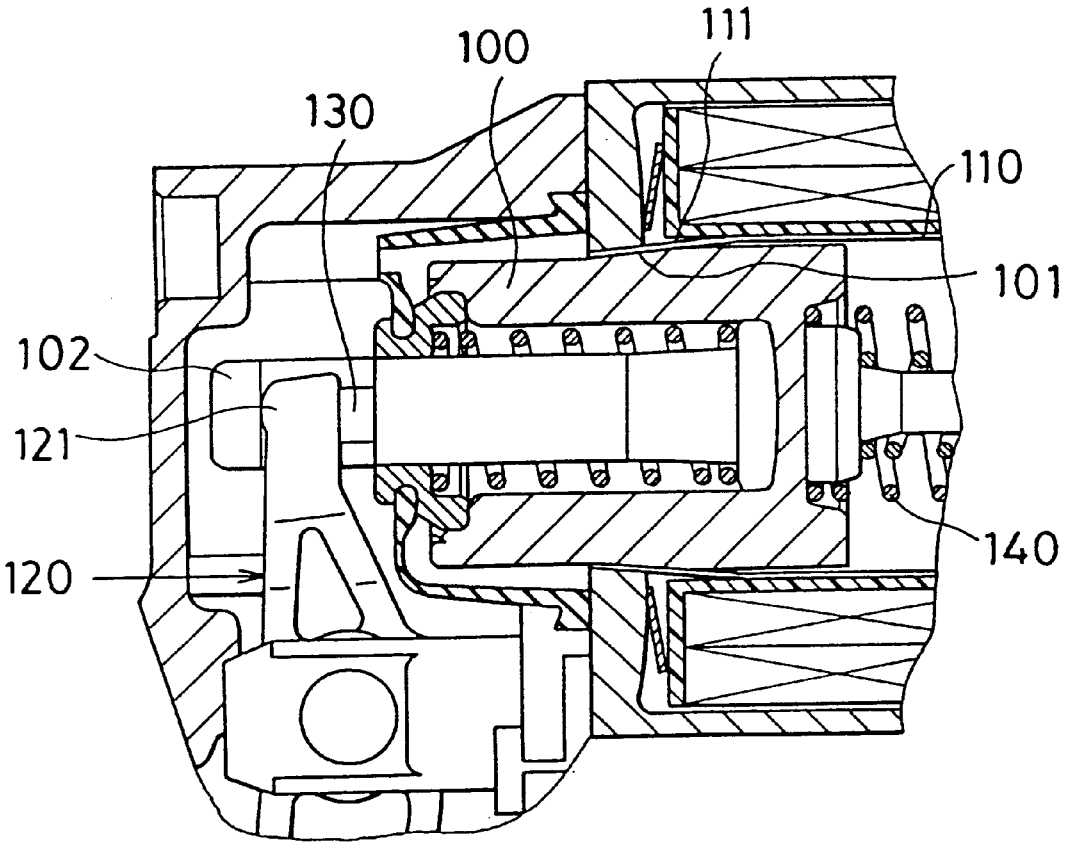
FIG. 11 PRIOR ART
FIG. 11 is a sectional view of main parts of a magnet switch of a conventional starter.

Further, when the magnet switch 405 is operated, the end of the operating portion 407*b* is moved away from the inclined wall 437*a* when the plunger 427 begins to be attracted by the magnetic force of the solenoid coil as shown in FIG. 10. Therefore, the force for biasing the plunger 427 toward the holder wall 442 is extinguished, which causes no sliding resistance of the plunger 427 with the sleeve.

The present invention should not be limited to the above embodiments or modifications and variations thereof, but may be modified or varied in many other ways without departing from the spirit of the invention.

What is claimed is:

1. A starter for an engine having a ring gear, comprising:

a starter motor for generating a turning force;

an output shaft rotatable by said starter motor;

a pinion moving member having a pinion gear engageable with said ring gear of said engine, said pinion moving member being provided movably on said output shaft;

a magnet switch having a plunger disposed slidably within a tubular sleeve and a return spring for biasing said plunger in an axial direction of said sleeve, said plunger being movable to open and close a motor contact interposed in an energization circuit of said starter motor;

a lever having one end connected to said plunger and another end connected to said pinion moving member, said lever moving said pinion moving member in an axial direction of said starter motor by movement of said plunger; and press means, provided in an engaging portion between said plunger and said lever, for biasing said plunger in a diametrical direction to press it against a fixed part in order to have a tight contact with said tubular sleeve and restrict said movement between said plunger and said sleeve.

2. A starter according to claim 1, wherein said press means includes an inclined surface for imparting a bias force of said return spring in a diametrical direction on said plunger.

3. A starter according to claim 2, wherein said inclined surface is provided in said engaging portion of said plunger and said fixed part is said sleeve.

4. A starter for an engine having a ring gear, comprising:

a starter motor for generating a turning force when energized;

an output shaft to be driven by said starter motor;

a magnet switch having a tubular sleeve, a solenoid coil wound around said sleeve, a plunger disposed slidably within said tubular sleeve and a return spring for biasing said plunger in an axial direction of said sleeve, said plunger being movable to control a starter operation; and press means for pressing said plunger in a diametrical direction to said sleeve to have a tight contact with said sleeve to restrict a relative movement between said plunger and said sleeve when said solenoid coil is deenergized.

5. A starter according to claim 4, wherein said press means includes an inclined surface for imparting a press force of said return spring in a diametrical direction on said plunger.

6. A starter according to claim 5, wherein said inclined surface is provided on a part which is movable with said plunger.

7. A starter according to claim 5, wherein said inclined surface is provided on a part which is unmovable with said plunger.

* * * * *